US011141997B2

(12) United States Patent
Yoda

(10) Patent No.: US 11,141,997 B2
(45) Date of Patent: Oct. 12, 2021

(54) MEDIUM HEATING DEVICE AND HEATING METHOD

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/799,417

(22) Filed: Feb. 24, 2020

(65) Prior Publication Data

US 2020/0269608 A1 Aug. 27, 2020

(30) Foreign Application Priority Data

Feb. 27, 2019 (JP) ..... JP2019-033838

(51) Int. Cl.
*B41J 29/38* (2006.01)
*B41J 11/00* (2006.01)

(52) U.S. Cl.
CPC ..... *B41J 11/002* (2013.01)

(58) Field of Classification Search
None
See application file for complete search history.

(56) References Cited

U.S. PATENT DOCUMENTS 9,932,190 B2 * 4/2018 Wada ..... B65H 23/198
2009/0244231 A1 * 10/2009 Tsuji ..... B41J 11/0085 347/102
2012/0038724 A1 * 2/2012 Sanada ..... B41J 11/002 347/102
2017/0057257 A1 * 3/2017 Nakano ..... B41J 29/02
2018/0056682 A1 * 3/2018 Kyaw ..... B65H 29/006

FOREIGN PATENT DOCUMENTS

JP 2003-136791 A 5/2003
JP 2004-136450 A 5/2004
JP 2009280320 A * 12/2009
JP 2016-155291 A 9/2016

* cited by examiner

*Primary Examiner* — Erica S Lin
*Assistant Examiner* — Tracey M McMillion
(74) *Attorney, Agent, or Firm* — Workman Nydegger

(57) ABSTRACT

A liquid ejecting device includes a heating unit configured to heat a medium transported in a state where liquid adheres to the medium, and a control unit configured to control the heating unit. The control unit determines whether the medium is wound downstream, in a transport direction, from an area heated by the heating unit. When the control unit determines that the medium is wound, the control unit controls the heating unit at a first heating set temperature, and, when the control unit determines that the medium is not wound, the control unit controls the heating unit at a second heating set temperature that is lower than the first heating set temperature.

5 Claims, 5 Drawing Sheets

MEDIUM HEATING DEVICE AND HEATING METHOD

The present application is based on, and claims priority from JP Application Serial Number 2019-033838, filed Feb. 27, 2019, the disclosure of which is hereby incorporated by reference herein in its entirety.

BACKGROUND

The present disclosure relates to a medium heating device and a heating method for heating a medium such as a sheet to which liquid such as ink adheres.

For example, JP-A-2004-134650 discloses an inkjet printer device that ejects liquid such as ink onto a medium such as a sheet, and performs printing. The printer device includes a winding device that winds a medium after printing in a roll shape. The printer device includes a means for calculating a time until printed ink is dried, a means for storing an ink drying time at a plurality of locations, a time measurement means for examining a lapse of the ink drying time, and a means for determining whether or not the ink drying time at the plurality of locations within a range of a sheet wound on the winding device is completed. When the ink drying time of the sheet is not completed, printing is prohibited. When the ink drying time of the sheet is completed, printing is permitted. Thus, winding of a medium such as a sheet is performed after ink is sufficiently dried, and thus offset of the printed ink can be prevented.

Further, in order to reduce a drying time of liquid such as ink adhering to a medium by printing, a printing device including a heating device that heats a printed medium before winding and dries liquid is known (for example, JP-A-2016-155291 and the like).

SUMMARY

However, the inkjet printer device described in JP-A-2004-136450 dries a medium by natural drying, and thus drying takes time and productivity of a printed material is low. On the other hand, in the printing device described in JP-A-2016-155291, the productivity is improved because a medium is heated by the heating device, but wrinkles may be generated due to thermal shrinkage of the medium. In particular, when a medium is not wound, and offset is less likely to occur, a problem in that wrinkles generated in the medium due to heating cause a decrease in printing quality becomes obvious.

A medium heating device, according to one embodiment, includes a heating unit configured to heat a medium transported in a state where liquid adheres to the medium, and a control unit configured to control the heating unit, the control unit determines whether the medium is wound downstream, in a transport direction, from an area heated by the heating unit, when the control unit determines that the medium is wound, the control unit controls the heating unit at a first heating set temperature, and, when the control unit determines that the medium is not wound, the control unit controls the heating unit at a second heating set temperature that is lower than the first heating set temperature.

In another embodiment, a heating method is a heating method for heating a medium transported in a state where liquid adheres to the medium, and the heating method includes determining whether the medium is wound downstream, in a transport direction, from a heated area of the medium heated by the heating unit, controlling, when it is determined that the medium is wound, the heating unit at a first heating set temperature, and controlling, when it is determined that the medium is not wound, the heating unit at a second heating set temperature that is lower than the first heating set temperature.

DESCRIPTION OF EXEMPLARY EMBODIMENTS

A liquid ejecting device according to one exemplary embodiment will be described below with reference to the accompanying drawings.

Figure 1:
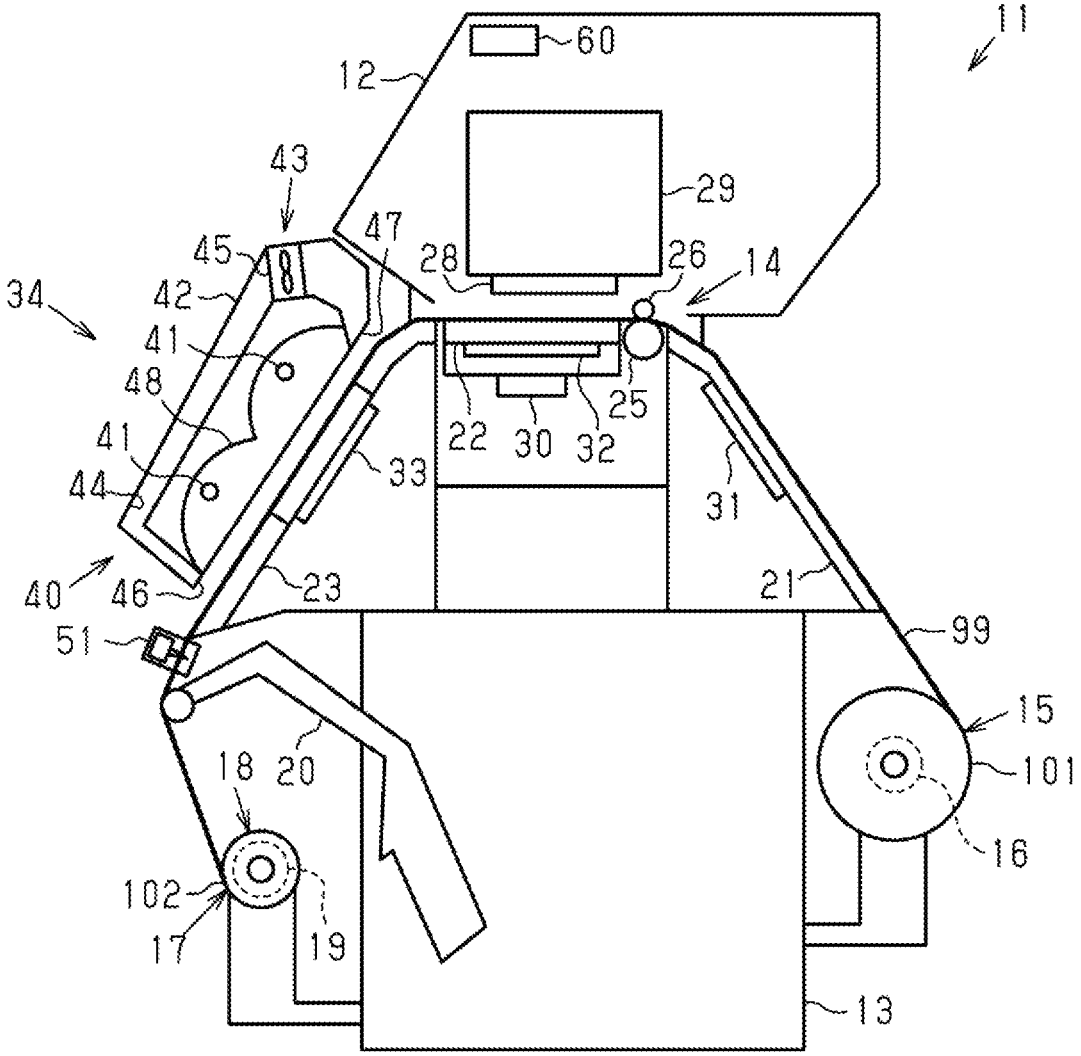
FIG. 1 is a cross-sectional side view schematically illustrating a liquid ejecting device including a heating unit according to one exemplary embodiment.

As illustrated in FIG. 1, a liquid ejecting device 11 as an example of a medium heating device is, for example, an ink jet-type printer that prints an image such as characters and photographs by ejecting ink, which is an example of liquid, onto a medium such as a sheet. The liquid ejecting device 11 includes a housing 12 and a base 13 that supports the housing 12.

The liquid ejecting device 11 includes a transport unit 14 that transports a medium 99. The transport unit 14 is provided in the housing 12, and transports the medium 99 along a predetermined transport path. The liquid ejecting device 11 includes a feeding unit 15 that can support a roll body 101 on which the medium 99 before liquid is ejected is wound. The feeding unit 15 is attached to the base 13, for example, and supports the roll body 101 in a rotatable state. The feeding unit 15 includes a feeding motor 16 that is driven when the roll body 101 is rotated in an unwinding direction. The transport unit 14 transports the long medium 99 unwound from the roll body 101 by the feeding unit 15. Note that, in the present exemplary embodiment, a transport direction of the medium 99 is a direction in which the medium 99 unwound from the roll body 101 is transported along the transport path.

The liquid ejecting device 11 includes an ejecting unit 28 that ejects liquid onto the medium 99 transported by the transport unit 14. The ejecting unit 28 is provided on a lower portion of a carriage 29. The carriage 29 scans the transported medium 99 in a width direction intersecting the transport direction of the medium 99. In other words, the liquid ejecting device 11 is a serial printer in which the ejecting unit 28 scans the medium 99. The liquid ejecting device 11 may be a line printer in which the ejecting unit 28 is disposed in a long shape so as to be able to eject liquid all at once onto a range of the medium 99 across the width direction. Note that the ejecting unit 28 and the carriage 29 are disposed in the housing 12.

As illustrated in FIG. 1, the liquid ejecting device 11 includes a winding unit 17 that winds the medium 99 on which an image and the like are printed by ejecting liquid. The winding unit 17 is attached to the base 13, for example. The winding unit 17 includes a reel mechanism 18 capable of winding, as a roll body 102, the medium 99 printed by ejecting liquid. The reel mechanism 18 includes a winding motor 19 that is driven when the roll body 102 is wound.

The liquid ejecting device 11 includes a tension bar 20 that applies tension to the medium 99. A length of the medium 99 between the winding unit 17 and the transport unit 14 varies in accordance with a difference between a feed amount of the medium 99 in the winding unit 17 and a feed amount of the medium 99 in the transport unit 14. The tension bar 20 changes its position in accordance with a length of the medium 99 between the winding unit 17 and the transport unit 14. In this way, the tension bar 20 that contacts the medium 99 changes the position, and thus appropriate tension is applied to the medium 99. By applying the tension to the medium 99 with the tension bar 20, liquid can accurately land on the medium 99. The tension bar 20 contacts a portion of the medium 99 passed through a drying device 40 and a portion of the medium 99 before being wound around the winding unit 17.

The tension bar 20 is attached to the base 13, for example. The tension bar 20 is attached to the base 13 in a manner allowing for its position to be changed. By changing the position of the tension bar 20, the amount of the tension applied to the medium 99 is adjusted.

The liquid ejecting device 11 includes an upstream support portion 21, a support portion 22, and a downstream support portion 23 that constitute the transport path for transporting the medium 99. The upstream support portion 21, the support portion 22, and the downstream support portion 23 support the medium 99 transported by the transport unit 14. The upstream support portion 21, the support portion 22, and the downstream support portion 23 are located in that order from the upstream side to the downstream side in the transport path. The support portion 22 is located in the housing 12. Specifically, the upstream support portion 21 constitutes an upstream portion of the transport path, and supports the medium 99 in a portion from the feeding unit 15 to the transport unit 14. The support portion 22 constitutes a midstream portion of the transport path, and supports the medium 99 in a portion downstream from the transport unit 14 and facing the ejecting unit 28. The downstream support portion 23 constitutes a downstream portion of the transport path, and supports a printed portion, to which liquid ejected by the ejecting unit 28 adheres, of the medium 99 transported downstream by the transport unit 14. In the example illustrated in FIG. 1, the support portion 22 is disposed horizontally, and the upstream support portion 21 and the downstream support portion 23 located on both sides of the support portion 22 in the transport direction are disposed in an inclined state, thereby forming a mountain-shaped transport path including a top surface that expands in a horizontal direction.

As illustrated in FIG. 1, the transport unit 14 includes a driving roller 25 and a driven roller 26. The driving roller 25 and the driven roller 26 transport the medium 99 by rotating in a nip state of sandwiching the medium 99. The driving roller 25 and the driven roller 26 are located between the upstream support portion 21 and the support portion 22 in the transport path. The driving roller 25 transports the medium 99 with a transport motor 65 (see FIG. 6) as a power source. The driving roller 25 and the driven roller 26 constitutes a roller pair capable of nipping the medium 99. The driving roller 25 and the driven roller 26 are switched between a spaced state of being spaced from each another and the nip state of sandwiching the medium 99 therebetween. The liquid ejecting device 11 is provided with an operation lever (not illustrated) capable of switching the driving roller 25 and the driven roller 26 between the spaced state and the nip state by being operated by a user.

The liquid ejecting device 11 includes the above-described ejecting unit 28 that ejects liquid onto the medium 99 supported by the support portion 22. The ejecting unit 28 is located in the housing 12. The ejecting unit 28 is disposed in a position facing the support portion 22. Thus, the ejecting unit 28 ejects liquid onto a portion of the medium 99 supported by the support portion 22.

As illustrated in FIG. 1, a suction mechanism 30 for sucking the medium 99 to the support portion 22 with negative pressure is provided below the support portion 22. The suction mechanism 30 sucks and supports the medium 99 to the support portion 22 by acting negative pressure on a suction hole 35 (see FIG. 3) that is formed in the support portion 22. And the suction hole 35 is open in a support surface 22A that is a surface that contacts the medium 99 supported by the support portion 22.

Further, as illustrated in FIG. 1, the upstream support portion 21, the support portion 22, and the downstream support portion 23 respectively include heaters 31, 32, and 33. Specifically, a preheater 31 that heats the upstream support portion 21 is provided on a back surface of the upstream support portion 21, a platen heater 32 that heats the support portion 22 is provided on a back surface of the support portion 22, and an afterheater 33 that heats the downstream support portion 23 is provided on a back surface of the downstream support portion 23. The preheater 31 preheats a portion of the medium 99 before printing by the heat of the heated upstream support portion 21. The platen heater 32 heats a portion of the ejected area of the medium 99 in which the liquid is to be ejected from a nozzle 28A of the ejecting unit 28 by the heat of the heated support portion 22. The afterheater 33 heats a portion of the medium 99 after printing by the heat of the heated downstream support portion 23. Note that each of the heaters 31 to 33 is, for example, a planar heater.

For example, a temperature of the preheater 31 and the platen heater 32 is set to approximately 40° C., and a temperature of the afterheater 33 is set to approximately 50° C. higher than the temperature of the preheater 31 and the platen heater 32. The preheater 31 gradually heats the medium 99 from an ambient temperature toward a heating temperature (approximately 40° C.) of the platen heater 32 via the upstream support portion 21. The platen heater 32 heats the medium 99 via the support portion 22, and quickly dries the ink landed on the medium 99. The afterheater 33 heats the medium 99 to a temperature (approximately 50° C.) higher than the heating temperature (approximately 40° C.) of the platen heater 32 via the downstream support portion 23, and dries and fixes the liquid landed on the medium 99 to the medium 99 before the medium 99 is wound by the reel mechanism 18.

As illustrated in FIG. 1, the liquid ejecting device 11 includes a heating unit 34 that heats the medium 99 transported in a state in which the liquid adheres. The heating unit 34 is located downstream from the position where the liquid is ejected by the ejecting unit 28 in the transport path. Thus, the heating unit 34 heats and dries the medium 99 to which the liquid adheres.

In the present exemplary embodiment, the heating unit 34 is the drying device 40 including a heater tube 41. The heater tube 41 is located so as to face the downstream support portion 23 that supports the medium 99 after printing. The heater tube 41 heats a printing surface of the medium 99 supported and transported by the downstream support portion 23. The heater tube 41 is controlled to a predetermined heating set temperature so as to appropriately dry the liquid adhering to the medium 99. In this case, an output of the heater tube 41 is increased with a higher heating set temperature.

The drying device 40 includes a case 42 that houses the heater tube 41, and a circulation unit 43 that circulates gas within the case 42. The case 42 is disposed in a position facing the downstream support portion 23. The circulation unit 43 includes a circulation path 44 through which gas flows, and a fan 45 located on the way of the circulation path 44. The circulation path 44 is a flow path connecting an intake port 46 that introduces gas and an air blowing port 47 that sends out gas. The circulation path 44 extends in a path surrounding the heater tube 41. The intake port 46 is located so as to face a downstream portion of the downstream support portion 23. The air blowing port 47 is located so as to face an upstream portion of the downstream support portion 23. The circulation unit 43 circulates the gas heated by the heater tube 41 within the case 42. Specifically, a part of the gas heated near the surface of the medium 99 is introduced from the intake port 46, the introduced gas is heated in a process of passing through the circulation path 44, and is blown back to the surface of the medium 99 from the air blowing port 47 by the fan 45, thereby facilitating drying of the medium 99.

The drying device 40 includes a reflecting plate 48 that reflects the heat of the heater tube 41 toward the downstream support portion 23. In this way, the heat of the heater tube 41 can be efficiently conveyed to the medium 99.

As illustrated in FIG. 1, the liquid ejecting device 11 includes a cutter device 51 that cuts the medium 99 in a position downstream from the drying device 40 in the transport direction. The printed medium 99 is dried and is then cut by the cutter device 51, and is cut into a plurality of sheets having a predetermined size. The cutter device 51 includes, for example, a movable blade and a fixed blade, and cuts the medium 99 by a predetermined length in the transport direction by movement of the movable blade in the width direction of the medium 99.

The liquid ejecting device 11 includes a control unit 60. The control unit 60 comprehensively controls the liquid ejecting device 11. The control unit 60 controls the transport unit 14, the feeding unit 15, the winding unit 17, the ejecting unit 28, the heating unit 34, and the like.

Figure 2:
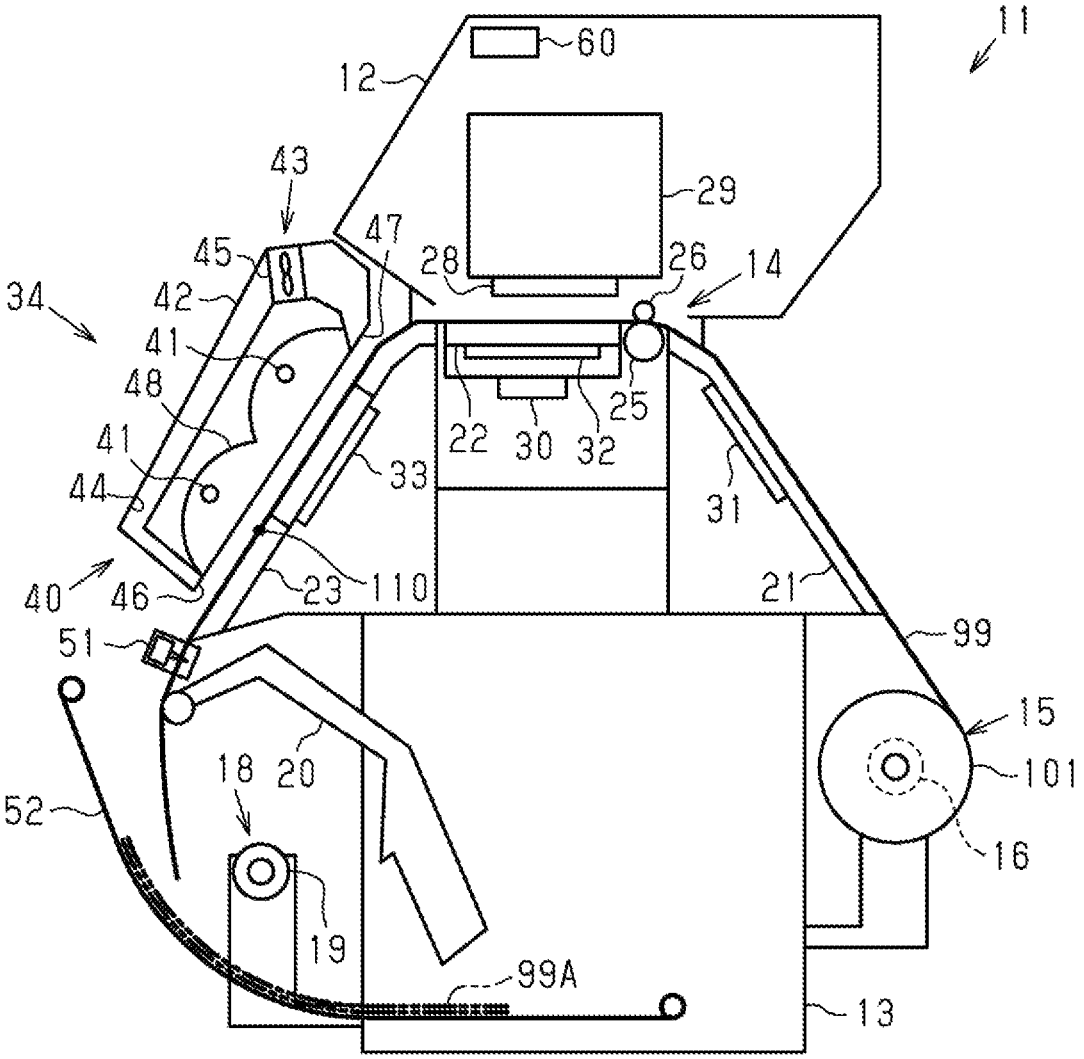
FIG. 2 is a cross-sectional side view schematically illustrating the liquid ejecting device without performing winding.

The liquid ejecting device 11 can select one of a winding method illustrated in FIG. 1 for winding, as the roll body 102, the medium 99 on which the printed liquid is dried and a non-winding method illustrated in FIG. 2 for not winding the medium 99 on which the printed liquid is dried. As illustrated in FIG. 2, when winding of the medium 99 is not performed, a medium receiving unit 52 that receives the medium 99 after the liquid is dried by the heating unit 34, a cut medium 99A, or the like is attached to the base 13. For example, the medium 99A of a predetermined size acquired by cutting the medium 99 after printing by the cutter device 51 is housed in the medium receiving unit 52 as indicated by a two-dot chain line in FIG. 2. Note that the medium 99 when the non-winding method is selected may remain in a long shape without being cut, and be housed in the medium receiving unit 52. The medium 99 after printing or the cut medium 99A may be dropped onto a sheet (not illustrated) placed on a floor.

Figure 3:
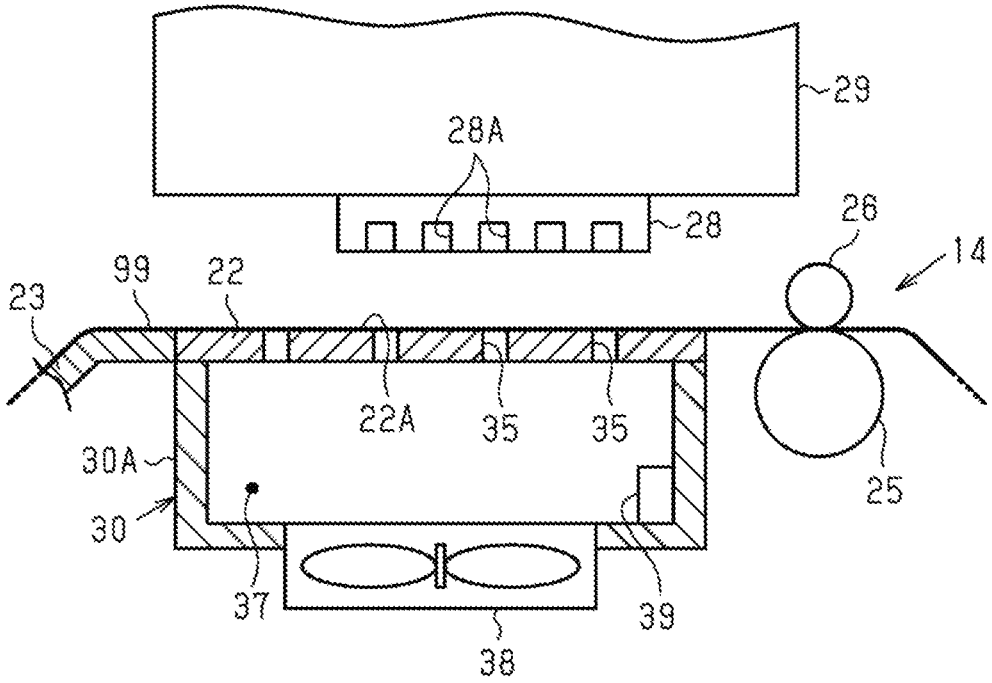
FIG. 3 is a cross-sectional side view illustrating a suction mechanism.

Next, a detailed configuration of the suction mechanism 30 will be described with reference to FIG. 3. As illustrated in FIG. 3, the support portion 22 includes the suction hole 35 open in the support surface 22A that contacts the medium 99. The liquid ejecting device 11 includes the suction mechanism 30 for generating negative pressure for acting a suction force that sucks the medium 99 on the suction hole 35. A negative pressure chamber forming member 30A is assembled to a lower portion of the support portion 22. Then, a negative pressure chamber 37 is surrounded and formed by the support portion 22 and the negative pressure chamber forming member 30A. The suction hole 35 extends through the support portion 22, and communicates with the negative pressure chamber 37. A plurality of suction holes 35 that communicate with the negative pressure chamber 37 are open in the support surface 22A. The suction mechanism 30 includes an exhaust fan 38 that discharges air in the negative pressure chamber 37 to the outside. When the exhaust fan 38 is driven, air in the negative pressure chamber 37 is discharged to the outside, and the pressure inside the negative pressure chamber 37 becomes negative. Therefore, the medium 99 is sucked and supported by the support portion 22 by the negative pressure acting on the plurality of suction holes 35 that are open in the support surface 22A.

In the liquid ejecting device 11, the exhaust fan 38 is driven, and the medium 99 is sucked and supported by the support surface 22A during printing in which the liquid is ejected from the ejecting unit 28 and an image is printed on the medium 99. Further, a pressure sensor 39 that detects pressure is provided in the negative pressure chamber 37. The control unit 60 controls the suction mechanism 30 such that pressure in the negative pressure chamber 37 has a predetermined set negative pressure value, based on detection pressure detected by the pressure sensor 39. In the present exemplary embodiment, the negative pressure acts on the suction hole 35 even when the medium 99 is transported, and the suction force that sucks the medium 99 to the support surface 22A acts on the medium 99 during transport. In this case, an excessive suction force in the transport process of the medium 99 increases a transport load on the medium 99, and may also cause generation of wrinkles due to the transport load. Note that control in which the negative pressure does not act on the suction hole 35 may be performed during transport of the medium 99.

When the medium 99 is wound as the roll body 102 by the reel mechanism 18 and is wound in a state in which a printing surface of the medium 99 is not sufficiently dried, there is a concern that liquid such as ink on the printing surface may be transferred to the medium 99 wound around an outer circumference of the reel mechanism 18 and offset may occur. In order to suppress this type of the offset, the liquid such as the ink on the printing surface needs to be sufficiently dried. Thus, in the present exemplary embodiment, when winding is performed, a heating set temperature of the drying device 40 is set to be higher than that when the winding is not performed.

Figure 4:
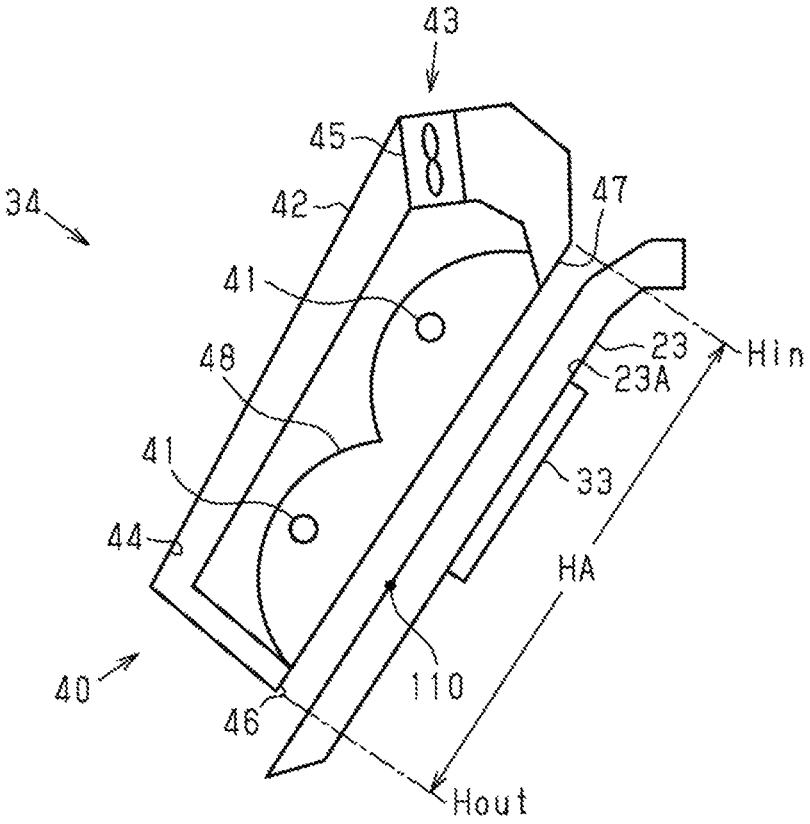
FIG. 4 is a cross-sectional side view illustrating a drying device.

As illustrated in FIG. 4, an area in which the medium 99 transported on a support surface 23A of the downstream support portion 23 is heated by the drying device 40 is a heated area HA. In the heated area HA, an upstream end in the transport direction of the air blowing port 47 is an inlet of the heating area HA, and a downstream end in the transport direction of the intake port 46 is an outlet of the heated area HA. The downstream support portion 23 is heated by the heat of the afterheater 33, and thus the heat is less likely to escape from the back surface of the medium 99. Then, the printing surface of the medium 99 transported on the support surface 23A is heated by the direct heat from the heater tube 41 and the heat reflected by the reflecting plate 48, and the fan 45 also blows hot air from the air blowing port 47 onto the printing surface of the medium 99, thereby accelerating drying of the printing surface of the medium 99.

On the other hand, when a heating set temperature of the drying device 40 is high, wrinkles are more likely to be generated in the medium 99 due to thermal shrinkage of fibers of the medium 99. When the negative pressure generated by the suction mechanism 30 is set to be great in order to suppress wrinkles in the medium 99, and the suction force acting on the suction hole 35 is great, generation of wrinkles is suppressed because the medium 99 is strongly sucked to the support surface 22A. In other words, when winding is performed, the negative pressure generated by the suction mechanism 30 is set to be greater than that when the winding is not performed, and thus generation of wrinkles is suppressed.

On the other hand, offset is less likely to occur when the winding of the medium 99 is not performed, and thus a heating set temperature of the drying device 40 is set to be lower than that when the winding is performed. When the heating set temperature is low, a possibility of generation of wrinkles due to thermal shrinkage of fibers of the medium 99 is low or a degree of an influence on printing quality due to generated wrinkles is low. Thus, the negative pressure generated in the suction mechanism 30 is set to be small.

In this way, in the present exemplary embodiment, a heating set temperature of the heating unit 34 is changed depending on the presence or absence of the winding of the medium 99 after printing. When the control unit 60 determines that the medium 99 is wound, the control unit 60 controls the heating unit 34 at a first heating set temperature K1. On the other hand, when the control unit 60 determines that the medium 99 is not wound, the control unit 60 controls the heating unit 34 at a second heating set temperature K2 that is lower than the first heating set temperature K1. In the present exemplary embodiment, the control unit 60 rotates the reel mechanism 18 in the winding direction, and determines whether or not the medium 99 is wound downstream in the transport direction from the heated area HA by the heating unit 34, based on a rotational load applied to the reel mechanism 18. The control unit 60 performs this determination before the operation of ejecting the liquid onto the medium 99.

Further, wrinkles due to thermal shrinkage are generated in the medium 99 when heat is applied at the first heating set temperature K1, Thus, the control unit 60 generates a relatively great first negative pressure V1 by the suction mechanism 30, and adsorbs the medium 99 to the support surface 22A of the support portion 22 with a relatively strong suction force, thereby stretching the medium 99 in a direction in which wrinkles of the medium 99 are eliminated. On the other hand, when heat is applied at the second heating set temperature K2 that is lower than the first heating set temperature K1, wrinkles are less likely to be generated than when heat is applied at the first heating set temperature K1. Thus, the control unit 60 generates a second negative pressure V2 that is smaller than the first negative pressure V1 by the suction mechanism 30. Therefore, the control unit 60 weakens the suction force acting on the suction hole 35 when heat is applied at the second heating set temperature K2 further than the suction force acting on the suction hole 35 when heat is applied at the first heating set temperature K1. Further, when the suction force is strong, a transport load on the medium 99 is increased when the medium 99 is transported on the support surface 22A, and there is a risk that wrinkles are generated in the medium 99 due to the increased transport load. In order to prevent this type of wrinkles, when heat is applied at the second heating set temperature K2, the control unit 60 weakens the suction force acting on the suction hole 35 by generating the second negative pressure V2 that is smaller than the first negative pressure V1 for heat application at the first heating set temperature K1. When the control unit 60 determines that the medium 99 is wound, the control unit 60 controls the suction mechanism 30 and generates the first negative pressure V1 in the suction hole 35. On the other hand, when the control unit 60 determines that the medium 99 is not wound, the control unit 60 controls the suction mechanism 30 and generates the second negative pressure V2 that is smaller than the first negative pressure V1. In other words, when the heating unit 34 is controlled at the second heating set temperature K2 without performing winding, the second negative pressure V2, which is smaller than the first negative pressure V1 at the first heating set temperature K1, is set as the negative pressure generated by the suction mechanism 30.

As illustrated in FIG. 4, there is a peak position 110 being a position in which the medium 99 transported on the support surface 23A of the downstream support portion 23 is at the highest temperature by heating the drying device 40. The peak position 110 is a position on the downstream support portion 23. When the afterheater 33 is not driven while the drying device 40 is driven, a temperature of the medium 99 transported on the downstream support portion 23 increases until the peak position 110 is reached.

The peak position 110 is specified by transporting, at a constant speed, the medium 99 in a dry state in which a temperature sensor is provided on a surface, for example. In other words, the peak position 110 is specified based on a detection temperature detected by the temperature sensor provided on the medium 99. The peak position 110 is specified based on a detection temperature by the temperature sensor when the medium 99 is transported at the lowest speed among transport speeds used for printing.

The amount of heating for heating the medium 99 and the time for heating the medium 99 determine a drying condition of the medium 99. Thus, the medium 99 may be quickly heated to a high temperature in order to quickly dry the medium 99. In order to quickly heat the medium 99 to a high temperature, a temperature at which the medium 99 is heated may be increased. However, in this case, there is a risk that the temperature of the medium 99 may be increased too high due to an overshoot. When the temperature of the medium 99 is increased too high, there is a concern that the medium 99 may be subjected to heat damage.

Figure 5:
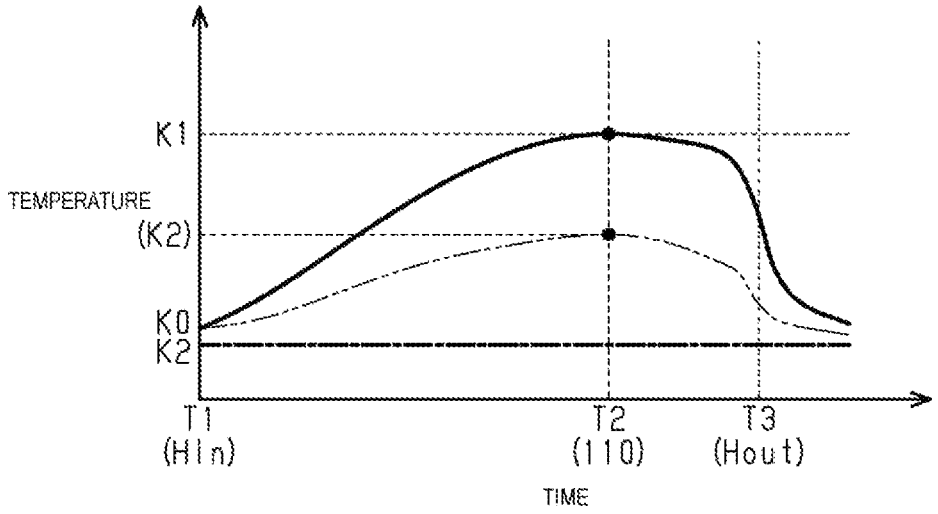
FIG. 5 is a graph illustrating a temperature profile of a medium surface temperature in a heated area of the heating unit.

As illustrated in FIG. 5, when a heating set temperature is set to a value higher than a room temperature, it is assumed that a time at which a temperature detection position of the medium 99 transported on the downstream support portion 23 is located at an inlet H in of the heated area HA is an initial time T1, and an initial temperature of the medium 99 at the initial time T1 is a temperature K0. The temperature of the medium 99 transported on the downstream support portion 23 at a constant transport speed increases over time. The temperature of the medium 99 becomes the highest temperature at a time T2. In other words, the medium 99 reaches the peak position 110 at the time T2. When the heater tube 41 of the drying device 40 is controlled at the heating set temperature K1, the temperature of the medium 99 becomes the temperature K1, which is the highest temperature by heating of the drying device 40, in the peak position 110.

When the temperature of the medium 99 exceeds the temperature K1, there is a risk that the medium 99 may be subjected to heat damage. This temperature K1 is set according to a type of the medium 99. In the present exemplary embodiment, the first heating set temperature K1 is set to a peak temperature in a temperature profile indicated by a solid line in FIG. 5. Further, as indicated by a dot-dash line in FIG. 5, the second heating set temperature K2 is set to a temperature when the heater tube 41 is not energized. Therefore, the second heating set temperature K2 includes not only a temperature provided by the heater tube 41 when actuating the heater tube 41, but also a room temperature when the heater tube 41 is OFF. In other words, when it is assumed that the heating set temperature is a temperature increased by the heater tube 41 from the room temperature, the heating set temperature also includes a case in which the increased temperature is "0 (zero)". Further, the second heating set temperature K2 may be set to a lower temperature than the first heating set temperature K1, and may be set to a peak temperature in a temperature profile indicated by a two-dot chain line in FIG. 5. Note that, in the graph of FIG. 5, the temperature detection position of the medium 99 reaches an outlet Hout of the heated area HA at a time T3. As the temperature detection position of the medium 99 approaches the outlet Hout of the heated area HA, the temperature of the medium 99 descends greatly from a temperature close to the peak temperature K1. When the temperature detection position of the medium 99 exits the outlet Hout, the temperature of the medium 99 gradually approaches the room temperature.

Figure 6:
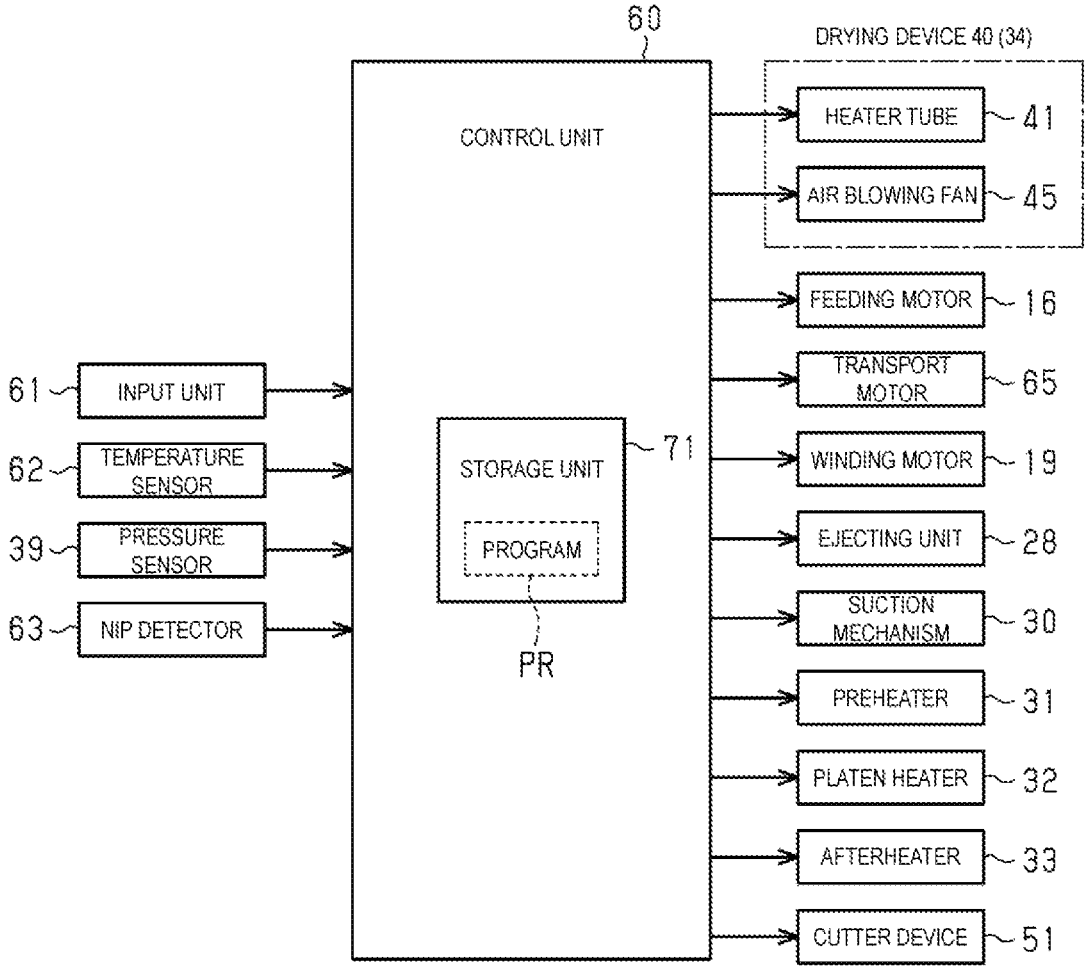
FIG. 6 is a block diagram illustrating an electrical configuration of the liquid ejecting device.

Next, an electrical configuration of the liquid ejecting device 11 will be described with reference to FIG. 6. As illustrated in FIG. 6, the liquid ejecting device 11 includes the control unit 60. As input systems, an input unit 61, a temperature sensor 62 capable of detecting a temperature of the heated area HA heated by the drying device 40, a pressure sensor 39 that detects pressure in the negative pressure chamber 37 of the suction mechanism 30, and a nip detector 63 that detects a nip state of the rollers 25 and 26 of the transport unit 14 are electrically coupled to the control unit 60. The control unit 60 inputs printing job data from the input unit 61, a detection signal of the temperature sensor 62, and a detection signal of the pressure sensor 39 via an input interface (not illustrated).

Note that the temperature sensor 62 detects, as a target, the peak position 110 in which a medium surface temperature becomes a peak temperature. The temperature sensor 62 may be a non-contact temperature sensor such as an infrared sensor (IR sensor) or a contact temperature sensor such as a thermistor that contacts the back surface of the downstream support portion 23. Further, the temperature sensor 62 may detect a temperature in a position different from the peak position 110, or detect a temperature other than the medium surface temperature, for example, a temperature in a position separated upward from the medium surface in an area where heat from the heater tube 41 extends. Also, in these cases, the control unit 60 controls the heating unit 34 such that a peak temperature becomes a heating set temperature, based on a detection temperature of the temperature sensor 62.

Further, as output systems, the heater tube 41, the air blowing fan 45, the feeding motor 16, and the transport motor 65, which is a drive source of the drive roller 25 of the transport unit 14, the winding motor 19, the ejecting unit 28, the suction mechanism 30, the preheater 31, the platen heater 32, and the afterheater 33 are electrically coupled to the control unit 60 via a plurality of drive circuits (not illustrated). In this example in which the liquid ejecting device 11 is a serial printer, a carriage motor (not illustrated), which is a drive source of the carriage 29, is electrically coupled to the control unit 60. Note that, when the liquid ejecting device 11 is constituted by a line printer, the configuration is the electrical configuration illustrated in FIG. 6 since a carriage motor is not provided.

Figure 7:
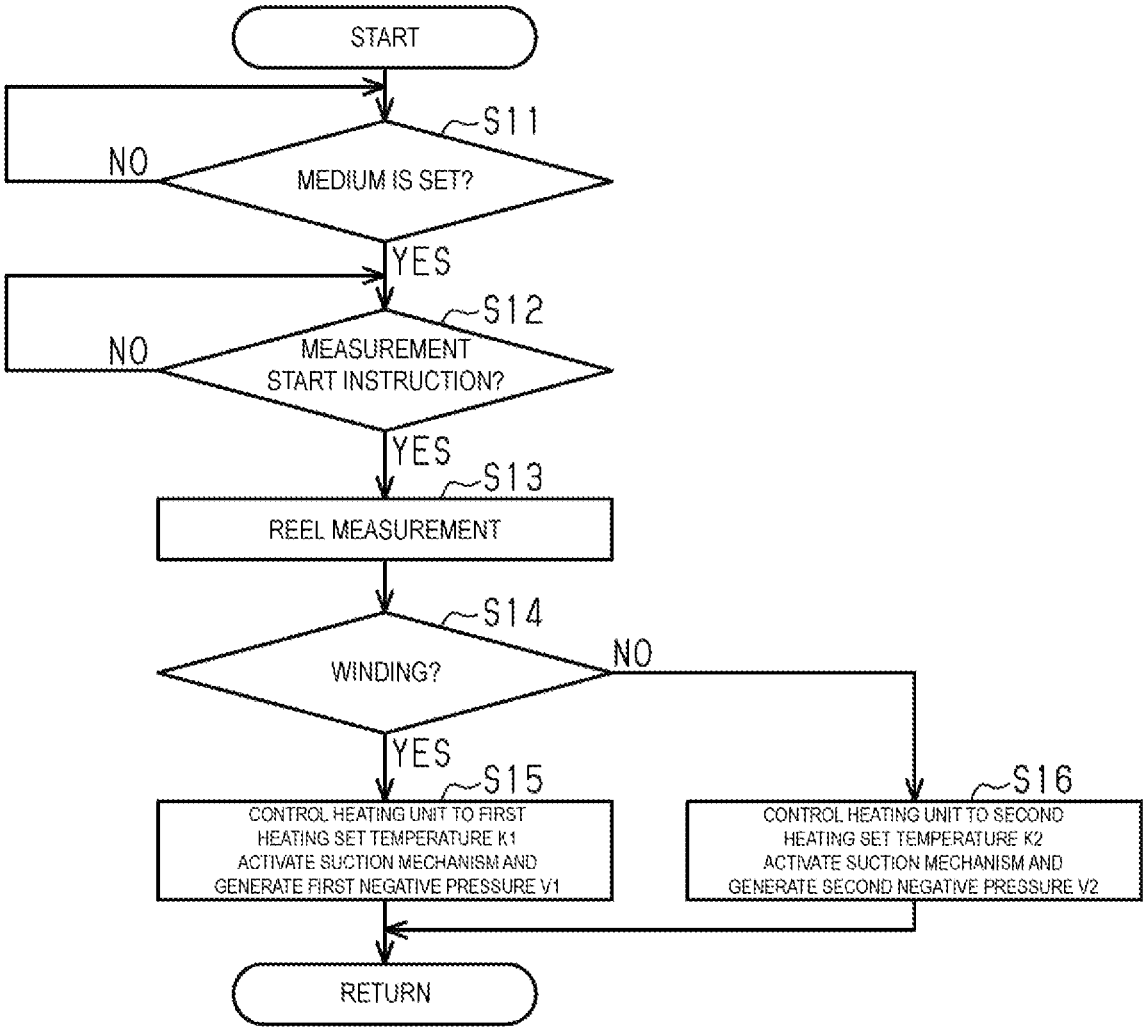
FIG. 7 is a flowchart illustrating a medium processing sequence.

The control unit 60 illustrated in FIG. 6 includes a CPU, an application specific integrated circuit (ASIC), and a storage unit 71 (memory) composed of a RAM, a nonvolatile memory, and the like. The CPU executes various types of control including print control by executing a control program stored in the storage unit 71. The storage unit 71 stores a program PR of a medium processing sequence included in the control program and illustrated in a flowchart in FIG. 7. After the power of the liquid ejecting device 11 is turned on, the program PR is executed by the control unit 60 before a first printing operation is started after the medium 99 is set. By performing this medium processing sequence, the control unit 60 performs determination of the presence or absence of winding, selection of a heating set temperature of the drying device 40 depending on the presence or absence of the winding, selection of negative pressure generated in the suction mechanism 30, control of the heating unit 34 at the selected heating set temperature, operation control of the suction mechanism 30 for generating the selected negative pressure, and the like.

The control unit 60 performs the medium processing sequence by executing the program PR read from the storage unit 71 after the power is turned on. Then, by the medium processing sequence, the control unit 60 performs a reel measurement upon receiving an instruction of a measurement start in a state in which the nip detector 63 detects a nip state in which the medium 99 is set. Then, the control unit 60 determines whether or not winding is performed, based on a measurement result of the reel measurement. Then, the control unit 60 determines a heating set temperature of the heating unit 34 and target negative pressure generated in the suction mechanism 30, depending on the presence or absence of the winding. The control unit 60 controls the heating unit 34 so as to set the determined heating set temperature, and also controls an operation of the suction mechanism 30 so as to generate the determined target negative pressure.

Here, the heating set temperature is a peak temperature in a process in which the medium 99 passes through the heated area HA. The control unit 60 controls the heating unit 34 such that the peak temperature becomes the heating set temperature. The control unit 60 controls the heating unit 34 such that the peak temperature, which is the surface temperature in the peak position 110 of the medium 99, becomes the heating set temperature, based on a detection temperature of the temperature sensor 62. The control unit 60 controls the heating unit 34 to the heating set temperature by controlling a current value supplied to the heater tube 41, based on a detection temperature of the temperature sensor 62.

The control unit 60 receives a print job by a user operating the input unit 61 included in a host device (not illustrated) communicably coupled to the liquid ejecting device 11 or the liquid ejecting device 11. The print job includes various commands required for the print control, printing condition information designated by the user, and print image data. The control unit 60 controls various motors 16, 19, and 65 and the like, based on the printing condition information included in the received print job, and also controls the ejecting unit 28 so as to eject liquid from the nozzle 28A capable of drawing, with a dot, an image based on the image data.

Further, the control unit 60 controls the heaters 31 to 33 to respective target temperatures by controlling current values supplied to the respective heaters 31 to 33. Further, the control unit 60 controls the amount of air blown from the air blowing port 47 to be a target value by controlling a rotational speed of the air blowing fan 45. Further, the control unit 60 causes target negative pressure to be generated in the negative pressure chamber 37 by controlling a rotational speed of the exhaust fan 38, based on detection pressure of the pressure sensor 39.

Next, action of the liquid ejecting device 11 will be described.

The user inputs and sets the printing condition information by operating a pointing device such as a keyboard and a mouse (none of them are illustrated) of the host device (not illustrated), or the input unit 61 of the liquid ejecting device 11. The printing condition information includes medium size, medium type, print color, the number of printing sheets, and the like.

The user operates an operation lever to a nip release operation position, and passes the medium 99 unwound from the roll body 101 set in the feeding unit 15 between both of the rollers 25 and 26 in the spaced state in which the driven roller 26 is spaced from the driving roller 25. Subsequently, the user operates the operation lever to a nip operation position, brings both of the rollers 25 and 26 into the nip state, and nips the medium 99 between the rollers 25 and 26. The nip position of both of the rollers 25 and 26 is detected by the nip detector 63. At this time, when the user performs winding, the user winds a tip end portion of the medium 99 around a core member of a roll set in the reel mechanism 18 of the winding unit 17. On the other hand, when the user does not perform winding, the tip end portion of the medium 99 is not wound around the core member. Furthermore, the user performs, on the host device or the input unit 61, an operation that triggers a reel measurement of the control unit 60.

The medium processing sequence performed by the control unit 60 will be described below. After the power of the liquid ejecting device 11 is turned on, the control unit 60 performs the medium processing sequence illustrated in the flowchart in FIG. 7 at timing before a start of printing.

First, in step S11, the control unit 60 determines whether or not the medium 99 is set. The medium 99 being set between the rollers 25 and 26 of the transport unit 14 is determined upon detection of the nip state of the rollers 25 and 26 by the nip detector 63. The user may instruct the liquid ejecting device 11 that the medium 99 is set in the nip state on the rollers 25 and 26 by operating the input unit 61. In this case, the control unit 60 determines that the medium 99 is set in the nip state upon receiving the instruction. When the medium 99 is not set, the control unit 60 waits until the medium 99 is set. On the other hand, when the medium 99 is set, the processing proceeds to step S12.

In step S12, the control unit 60 determines whether or not there is a measurement start instruction. Here, the user performs, on the host device or the input unit 61, an operation that triggers a reel measurement. The control unit 60 determines whether or not the measurement start instruction is received from the host device or the input unit 61. When the control unit 60 does not receive the measurement start instruction, the control unit 60 waits until the measurement start instruction is received. When the control unit 60 receives the measurement start instruction, the processing proceeds to step S13.

In step S13, the control unit 60 performs the reel measurement. In other words, the control unit 60 drives the winding motor 19 constituting the reel mechanism 18 in the winding direction, and performs the reel measurement by measuring a rotational load applied to the reel mechanism 18, based on a measurement of a rotational load acting on the winding motor 19 at that time. Specifically, the control unit 60 adjusts a rotational speed of the transport motor 65 and the winding motor 19, and drives the transport motor 65 in the transport direction and also drives the winding motor 19 in the winding direction while maintaining the medium 99 in a loose state without tension in an area downstream from the transport unit 14. Then, the rotational load acting on the winding motor 19 when the reel mechanism 18 is driven in the winding direction is measured. At this time, the rotational load acting on the winding motor 19 is measured for a period of time that allows transport of the medium 99 having a length equal to or greater than a predetermined value at which the medium 99 having a predetermined amount can be wound during winding.

In next step S14, the control unit 60 determines whether or not winding is performed. Specifically, the control unit 60 determines whether or not the rotational load acting on the reel mechanism 18 measured by the reel measurement exceeds a threshold value for winding determination, and determines that "winding" is performed when the threshold value is exceeded. On the other hand, when the rotational load applied to the reel mechanism 18 measured by the reel measurement is an idling load less than a threshold value for idling determination, the control unit 60 determines that "winding" is not performed. When the control unit 60 determines that "winding" is performed, the processing proceeds to step S15. When the control unit 60 determines that "winding" is not performed, the processing proceeds to step S16. Note that, when the rotational load applied to the reel mechanism 18 measured by the reel measurement is equal to or greater than the threshold value for the idling determination and equal to or less than the threshold value for the winding determination, the presence or absence of winding cannot be determined, and the reel measurement is performed again.

In step S15, the control unit 60 drives the liquid ejecting device 11 in a first mode being a mode during winding. In other words, the control unit 60 controls the heating unit 34 to the first heating set temperature K1, and also controls the suction mechanism 30 to generate the first negative pressure V1 in the negative pressure chamber 37. At this time, the control unit 60 controls the heating unit 34 such that a peak temperature becomes the first heating set temperature K1. Specifically, the control unit 60 controls a current value flowing to the heater tube 41 of the drying device 40 such that the peak temperature in the peak position 110 becomes the first heating set temperature K1, based on a detection temperature of the temperature sensor 62. In this way, a surface temperature of the medium 99 is heated by the heating unit 34 such that the peak temperature becomes the first heating set temperature K1 as indicated by the solid line in FIG. 5. At this time, the downstream support portion 23 is heated to approximately 50° C. by the afterheater 33. The medium 99 is heated by the heat of the afterheater 33 from the back surface, and the printing surface is heated in the temperature profile indicated by the solid line in FIG. 5, and thus the liquid on the printing surface of the medium 99 is sufficiently dried. Then, the dried medium 99 is wound as the roll body 102. At this time, the medium 99 is sufficiently dried, and thus there is no concern of offset. Here, the first heating set temperature K1 is set to a temperature at which heat damage to the medium 99 can be avoided according to a type of the medium 99. The first heating set temperature K1 is a value within a range of 80 to 120° C., for example, but can be appropriately changed as long as the temperature has high drying efficiency that can avoid heat damage to the medium 99. Note that, in the present exemplary embodiment, the air blowing fan 45 of the drying device 40 is driven at a predetermined airflow rate set during printing.

Further, the control unit 60 controls the suction mechanism 30 to generate the first negative pressure V1 in the negative pressure chamber 37. The first negative pressure is greater than the second negative pressure V2 during non-winding. Thus, the medium 99 during printing is sucked and supported by the support surface 22A by a strong suction force caused by the first negative pressure V1 acting on the suction hole 35 that is open in the support surface 22A of the support portion 22. For this reason, even when fibers of the medium 99 thermally shrink due to heating at the first heating set temperature K1, the medium 99 is sucked to the support surface 22A with a strong suction force, and thus generation of wrinkles is suppressed. In this way, the medium 99 is dried by heating at the first heating set temperature K1, and thus generation of wrinkles caused by thermal shrinkage of the medium 99 in a portion of the medium 99 supported by the support portion 22 is suppressed while avoiding occurrence of offset during winding. Thus, a reduction in printing quality caused by liquid landing onto a portion of wrinkles generated in the medium 99, a reduction in printing quality due to an ink stain of the medium 99 caused by wrinkles generated in the medium 99 rubbing against the ejecting unit 28, a failure of the ejecting unit 28, and the like can be prevented.

On the other hand, in step S16, the control unit 60 drives the liquid ejecting device 11 in a second mode being a non-winding mode. In other words, the control unit 60 controls the heating unit 34 to the second heating set temperature K2, and also controls the suction mechanism 30 to generate the second negative pressure V2 in the negative pressure chamber 37. In the present example, the air blowing fan 45 is driven in an OFF state in which the heater tube 41 of the drying device 40 stops being energized. In other words, while the back surface of the medium 99 is heated at approximately 40 degrees by the heat of the afterheater 33, the printing surface of the medium 99 is dried by blowing air. In this way, as indicated by the dot-dash line illustrated in FIG. 5, the drying device 40 is controlled to the second heating set temperature K2 at which heating is not performed. When the medium 99 is not wound in such a manner, heating by the heating unit 34 is not performed.

Further, in the temperature profile indicated by the two-dot chain line in FIG. 5, the heating unit 34 may be controlled to the second heating set temperature K2 in which the peak temperature is lower than the first heating set temperature K1. In this case, the printing surface of the medium 99 is more easily dried by heat from the heater tube 41 of the drying device 40, and, furthermore, the medium surface temperature does not become as high as that during winding. Thus, the medium 99 is less likely to be subjected to heat damage, and generation of wrinkles due to thermal shrinkage of the medium 99 is also further suppressed. In this way, for non-winding, generation of wrinkles is suppressed by not performing heating by the drying device 40, which causes the wrinkles of the medium 99, or weakening the heating, and negative pressure in the negative pressure chamber 37 generated by the suction mechanism 30 for preventing the wrinkles is set to the second negative pressure V2 that is smaller than the first negative pressure V1, thereby reducing a suction force on the medium 99 sucked to the support surface 22A of the support portion 22. This can effectively suppress generation of the wrinkles in the medium 99 caused by a great transport load acting between the medium 99 and the support surface 22A when a suction force that sucks the medium 99 is strong.

In this way, generation of wrinkles in the medium 99 during non-winding can be suppressed while avoiding occurrence of offset during winding. Then, in the first mode of performing winding, the winding motor 19 is driven and controlled so as to set, to be a target load, a value acquired by adding necessary tension to a reference load with reference to a rotational load measured by a reel measurement operation. As a result, desired tension is applied to the medium 99 during printing.

On the other hand, in the second mode without performing winding, the winding motor 19 is not driven. The medium 99 after printing is cut into ones of a predetermined size by driving the cutter device 51 in a position downstream from the drying device 40. The cut medium 99A is housed in the medium receiving unit 52 illustrated in FIG. 2 as indicated by the two-dot chain in FIG. 2, for example. Note that, in the second mode during non-winding, the medium 99 after printing may be housed so as to be folded into the medium receiving unit 52 without cutting by the cutter device 51, or may be dropped so as to be folded onto a sheet on a floor surface.

According to the present exemplary embodiment described above in detail, the following effects can be obtained.

(1) The liquid ejecting device 11 (an example of a medium heating device) includes the heating unit 34 configured to heat the medium 99 transported in a state in which liquid adheres, and the control unit 60 configured to control the heating unit 34. The control unit 60 determines whether or not the medium 99 is wound downstream in the transport direction from the heated area HA by the heating unit 34. When the control unit 60 determines that the medium 99 is wound, the control unit 60 controls the heating unit 34 at the first heating set temperature K1. On the other hand, when the control unit 60 determines that the medium 99 is not wound, the control unit 60 controls the heating unit 34 at the second heating set temperature K2 that is lower than the first heating set temperature K1. Thus, when the medium 99 is wound, the medium 99 is heated at the first heating set temperature K1 by the heating unit 34, and thus drying of the liquid adhering to the medium 99 is accelerated and offset becomes more difficult to occur during winding. On the other hand, when the medium 99 is not wound, the heated area HA of the heating unit 34 is controlled to the second heating set temperature K2. Thus, wrinkles caused by heating are less likely to be generated in the medium 99. Thus, offset when the medium 99 is wound can be suppressed, and generation of wrinkles when the medium 99 is not wound can be suppressed. Offset is prevented without reducing a production speed by heating the medium 99 during winding in such a manner, and generation of wrinkles is suppressed by lowering a heating set temperature during non-winding further than that during winding. Therefore, high productivity during winding and quality assurance during non-winding can be achieved in a compatible manner.

(2) The liquid ejecting device 11 further includes the reel mechanism 18 capable of winding the medium 99. The control unit 60 rotates the reel mechanism 18 in the winding direction, and determines whether or not the medium 99 is wound downstream in the transport direction from the heated area HA by the heating unit 34, based on a rotational load applied to the reel mechanism 18. Thus, the control unit 60 can determine whether or not the medium 99 is wound, based on a rotational load when the reel mechanism 18 is rotated in the winding direction.

(3) The control unit 60 rotates the reel mechanism 18 before an operation of ejecting the liquid onto the medium 99, and determines whether or not the medium 99 is wound downstream in the transport direction from the heated area HA by the heating unit 34, based on a rotational load applied to the reel mechanism 18. Thus, the control unit 60 rotates the reel mechanism 18 before the operation of ejecting the liquid onto the medium 99, and determines whether or not the medium 99 is wound downstream in the transport direction from the heated area HA by the heating unit 34, based on the rotational load applied to the reel mechanism 18. As a result, the medium 99 to which the ejected liquid adheres can be dried at an appropriate heating set temperature depending on the presence or absence of winding.

(4) The liquid ejecting device 11 includes the support portion 22 including the suction hole 35 open in the support surface 22A that contacts the medium 99, the ejecting unit 28 configured to eject the liquid onto the medium 99 supported by the support portion 22, and the suction mechanism 30 for generating negative pressure at the suction hole 35. When the control unit 60 determines that the medium 99 is wound, the control unit 60 controls the suction mechanism 30 to generate the first negative pressure V1 in the suction hole 35, and, when the control unit 60 determines that the medium 99 is not wound, the control unit 60 controls the suction mechanism 30 to generate the second negative pressure V2 that is smaller than the first negative pressure V1 in the suction hole 35. Thus, when the medium 99 is wound, the first negative pressure V1 generated by the suction mechanism 30 acts on the suction hole 35, and the medium 99 is sucked and supported by the support surface 22A of the support portion 22 with a strong suction force in accordance with the first negative pressure V1. Therefore, wrinkles are less likely to be generated in the medium 99 even when the medium 99 is heated at the first heating set temperature K1. On the other hand, when the medium 99 is not wound, the second negative pressure V2 generated by the suction mechanism 30 acts on the suction hole 35, and the medium 99 is sucked and supported by the support surface 22A of the support portion 22 with a weak suction force in accordance with the second negative pressure V2 that is smaller than the first negative pressure V1. When a temperature is the second heating set temperature K2, which is lower than the first heating set temperature K1, and wrinkles caused by heat of the medium 99 are less likely to be generated, a transport load when the medium 99 is transported on the support surface 22A of the support portion 22 can be reduced by weakening the suction force. Generation of wrinkles caused by the transport load on the medium 99 can be suppressed.

(5) The second heating set temperature K2 is a temperature when energization of the heating unit 34 is off. Thus, when winding is not performed, the heating unit 34 is not heated. As a result, there is no concern of generation of wrinkles due to heating in the medium 99, and power consumption of the heating unit 34 can also be suppressed.

(6) Since the first heating set temperature K1 is set to a peak temperature in the heated area HA of the heating unit 34, the medium 99 is not subjected to heat damage during winding of the medium 99.

(7) The heating method for heating the medium 99 transported in a state in which liquid adheres includes determining whether or not the medium 99 is wound downstream in the transport direction from the heated area HA in which the medium 99 is heated by the heating unit 34. When it is determined that the medium 99 is wound, the heating unit 34 is controlled at the first heating set temperature K1, and, when it is determined that the medium 99 is not wound, the heating unit 34 is controlled at the second heating set temperature K2 that is lower than the first heating set temperature K1. According to this heating method, an effect similar to that of the liquid ejecting device 11, which is an example of the medium heating device described in (1) described above, can be obtained.

Note that the above-described exemplary embodiment may be modified as the following modified examples. Furthermore, a further modified example can be acquired by appropriately combining the above-described exemplary embodiment and the modified examples described below, and a further modified example can also be acquired by appropriately combining the modified examples described below.

In the above-described exemplary embodiment, "determination of whether or not winding is performed" by the control unit 60 is not limited to determination by a rotational load when winding is performed by a reel measurement. For example, a configuration may be adopted where setting information in which one of the winding mode and the non-winding mode is previously selected and input by a user is stored in the storage unit 71, and the control unit 60 determines whether a mode is the winding mode or the non-winding mode, based on the setting information read from the storage unit 71.

The heating unit 34 is not limited to the drying device 40, and may be the afterheater 33. In this case, the control unit 60 controls the afterheater 33 to a first heating set temperature K11 during winding and a second heating set temperature K21 (<K11) during non-winding. Further, the heating unit 34 may be both of the drying device 40 and the afterheater 33. In this case, the control unit 60 controls the drying device 40 to the first heating set temperature K1 during winding and the second heating set temperature K2 (<K1) during non-winding, and also controls the afterheater 33 to the first heating set temperature K11 during winding and the second heating set temperature K21 (<K11) during non-winding. Note that, in a configuration in which the afterheater 33 is used as the heating unit 34, the drying device 40 may be eliminated. In the above-described exemplary embodiment, the afterheater 33 may be eliminated.

Negative pressure generated by the suction mechanism 30 may be the same in the winding mode and the non-winding mode. Further, the suction mechanism 30 may be eliminated. In addition, the suction mechanism 30 may be configured to be activated only in a period during which the carriage 29 performs scanning and printing of one pass on the medium 99, and adsorb the medium 99 on the support surface 22A, and may be configured to cause negative pressure not to act on the suction hole 35 in a transport period of the medium 99.

The medium heating device may be a device different from the liquid ejecting device 11. For example, the medium heating device may be a medium heating device including the heating unit 34 that dries the medium 99 transported in a state in which liquid adheres from the liquid ejecting device 11. In this case, the medium heating device may include a winding device that winds the medium 99 dried by the heating unit 34. The medium heating device may transport the medium 99 dried by the heating unit 34 to another device including the winding device. The liquid ejecting device 11 as an example of a medium heating device may not include the feeding unit 15, and may include the ejecting unit 28 that ejects liquid onto the medium 99 unwound from the feeding unit 15 included in another device, and the heating unit 34.

In the above-described exemplary embodiment, the mountain-shaped transport path including the flat top surface is formed by obliquely disposing the upstream support portion 21 and the downstream support portion 23 on both sides of the support portion 22, but a transport path may extend horizontally and be entirely flat.

The heating unit 34 is not limited to the drying device 40 and the afterheater 33. The heating unit 34 may be a resistance heating element or an infrared lamp heater.

The medium 99 is not limited to a sheet, and may be a synthetic resin film or sheet, a cloth, a nonwoven fabric, a laminate sheet, and the like.

The liquid ejecting device 11 is not limited to an inkjet printer, and may be an inkjet printing device. Further, the liquid ejecting device 11 may be a composite device having a scanner mechanism and a copy function in addition to the printing function.

Hereinafter, effects that are understood from the above-described exemplary embodiment and modified examples will be described.

According to the above-described configuration, when the medium is wound, the medium is heated at the first heating set temperature by the heating unit, and thus drying of the liquid adhering to the medium is accelerated and offset becomes more difficult to occur during winding. On the other hand, when the medium is not wound, the heated area of the heating unit is controlled to the second heating set temperature. Thus, wrinkles caused by heating are less likely to be generated in the medium. Thus, offset when the medium is wound can be suppressed, and generation of wrinkles when the medium is not wound can be suppressed.

According to the above-described configuration, the control unit can determine whether or not the medium is wound, based on a rotational load when the reel mechanism is rotated in the winding direction.

According to the above-described configuration, the control unit rotates the reel mechanism before the operation of ejecting the liquid onto the medium, and determines whether or not the medium is wound downstream, in the transport direction, from the area heated by the heating unit, based on a rotational load applied to the reel mechanism. As a result, the medium to which the ejected liquid adheres can be dried at an appropriate heating set temperature depending on the presence or absence of winding.

According to the above-described configuration, when the medium is wound, the first negative pressure generated by the suction mechanism acts on the suction hole, and the medium is sucked and supported by the surface of the support portion with a strong suction force in accordance with the first negative pressure. Therefore, wrinkles are less likely to be generated in the medium even when the medium is heated at the first heating set temperature. On the other hand, when the medium is not wound, the second negative pressure generated by the suction mechanism acts on the suction hole, and the medium is sucked and supported by the surface of the support portion with a weak suction force in accordance with the second negative pressure that is smaller than the first negative pressure. When a temperature is the second heating set temperature, which is lower than the first heating set temperature, and wrinkles caused by heat of the medium are less likely to be generated, a transport load when the medium is transported on the surface of the support portion can be reduced by weakening the suction force. Generation of wrinkles caused by the transport load on the medium can be suppressed.

According to the above-described configuration, when winding is not performed, the heating unit is not heated. As a result, there is no concern of generation of wrinkles due to heating in the medium, and power consumption of the heating unit can also be suppressed.

According to the above-described configuration, the medium is not subjected to heat damage during winding of the medium.

According to the above-described configuration, an effect similar to that of the medium heating device described above can be obtained.

What is claimed is:

1. A medium heating device, comprising:

a heating unit configured to heat a medium transported in a state where liquid adheres to the medium;

a reel mechanism configured to wind the discharged medium onto a roll body that is downstream from the heating unit; and a control unit configured to control the heating unit, wherein the control unit determines whether the medium is wound downstream, in a transport direction, from an area heated by the heating unit onto the roll body by the reel mechanism, when the control unit determines that the discharged medium is wound on the roll body by the reel mechanism, the control unit controls the heating unit at a first heating set temperature, and when the control unit determines that the discharged medium is discharged without being wound on the roll body by the reel mechanism, the control unit controls the heating unit at a second heating set temperature that is lower than the first heating set temperature.

2. The medium heating device according to claim 1, wherein the control unit rotates the reel mechanism in a winding direction, and, based on a rotational load exerted on the reel mechanism, determines whether the medium is wound downstream, in the transport direction, from the area heated by the heating unit.

3. The medium heating device according to claim 2, wherein the control unit rotates the reel mechanism before an operation of ejecting the liquid onto the medium, and determines, based on a rotational load exerted on the reel mechanism, whether the medium is wound downstream, in the transport direction, of the area heated by the heating unit.

4. The medium heating device according to claim 1, comprising:

a support portion in which a suction hole is formed, the suction hole being open in a surface contacting the medium;

an ejecting unit configured to eject the liquid onto the medium supported by the support portion; and a suction mechanism configured to generate negative pressure at the suction hole, wherein when the control unit determines that the medium is wound, the control unit controls the suction mechanism to generate first negative pressure at the suction hole, and, when the control unit determines that the medium is not wound, the control unit controls the suction mechanism to generate second negative pressure, which is smaller than the first negative pressure, at the suction hole.

5. A heating method for heating a medium transported in a state where liquid adheres to the medium, the heating method comprising:

determining whether the discharged medium is wound downstream, in a transport direction, from a heated area in which the medium is heated by a heating unit onto a roll body by a reel mechanism;

controlling, when it is determined that the discharged medium is wound onto the roll body by the reel mechanism, the heating unit at a first heating set temperature; and controlling, when it is determined that the discharged medium is not wound onto the roll body by the reel mechanism, the heating unit at a second heating set temperature that is lower than the first heating set temperature.

* * * * *